175-48 SR
11/8/83 XR 4,413,511

United States Patent [19]
Godbey

[11] 4,413,511
[45] Nov. 8, 1983

[54] SYSTEM FOR MEASURING CUTTINGS AND MUD CARRYOVER DURING THE DRILLING OF A SUBTERRANEAN WELL

[75] Inventor: John K. Godbey, Dallas, Tex.

[73] Assignee: Mobil Oil Corporation, New York, N.Y.

[21] Appl. No.: 357,516

[22] Filed: Mar. 12, 1982

[51] Int. Cl.[3] ..... E21B 49/08
[52] U.S. Cl. ..... 73/155; 175/48; 175/66
[58] Field of Search ..... 73/155; 175/38, 48, 175/66

[56] References Cited

U.S. PATENT DOCUMENTS

| | | | |
|---|---|---|---|
| 2,966,059 | 12/1960 | Dower | 175/48 |
| 3,726,136 | 4/1973 | McKean et al. | 175/48 |
| 3,729,986 | 5/1973 | Leonard | 73/155 |
| 4,043,193 | 8/1977 | Bailey | 73/155 |
| 4,250,974 | 2/1981 | Heilhecker et al. | 175/48 |
| 4,353,803 | 10/1982 | Dover, Jr. | 175/66 |

*Primary Examiner*—Howard A. Birmiel
*Attorney, Agent, or Firm*—Charles A. Huggett; James F. Powers, Jr.; Lawrence O. Miller

[57] ABSTRACT

This invention discloses a method and system for continuously measuring the amount of solid cuttings picked up by a drilling mud being circulated in a well being drilled into subterranean formations and the amount of drilling mud carried over with the cuttings when the cuttings are separated from the drilling mud by a shale shaker. The cuttings and carryover mud discharged from the shale shaker are introduced into a vessel wherein the weight and volume of the solid cuttings and carryover mud are continuously measured and the volume fraction of solid cuttings $\phi_c$ is determined in accordance with the following equation:

$$\phi_c = \frac{W_t/V_t - p_m}{p_c - p_m}$$

wherein W is the weight of a fixed volume of solid cuttings and carryover mud discharged from the shale shaker, V is the volume of solid cuttings and carryover mud discharged from the shale shaker, $P_m$ is the density of the drilling mud, and $P_c$ is the density of the solid cuttings. The volume fraction of the carryover mud $\phi_m$ is determined in accordance with the following equation:

$$\phi_m = 1 - \phi_c.$$

8 Claims, 7 Drawing Figures

SYSTEM FOR MEASURING CUTTINGS AND MUD CARRYOVER DURING THE DRILLING OF A SUBTERRANEAN WELL

FIELD AND BACKGROUND OF THE INVENTION

1. Field of the Invention

This invention relates to a method and system for continuously measuring the volume of solid cuttings in a drilling mud discharged from a well during a rotary drilling operation and the volume of mud carried over with the cuttings during separation of the cuttings from the drilling mud utilizing a shale shaker.

2. Background of the Invention

As is well known, drilling fluids are employed when drilling holes into subterranean formations. The drilling fluid, usually referred to as drilling mud, consists of a mixture of liquids and solids to provide special properties to better perform the following primary functions in a drilling well. These functions are:

1. To lift the formation cuttings to the surface.
2. To control subsurface pressure.
3. To lubricate the drill string and bit.
4. To aid bottom-hole cleaning.
5. To provide an aid to formation evaluation.
6. To provide protection to formation productivity.

The drilling mud is circulated down the drill string, through the bit, and returns to the surface through the annular space between the drill string and the borehole wall. The drilled cuttings are picked up at the bit and returned to the surface for separation from the mud and for disposal. This removal of the drilled solids from the mud stream is critical to the subsequent reconditioning of the mud for recirculation in the well.

The hole-cleaning ability of the mud is a very important parameter. The buildup of cuttings in the annulus can contribute to, if not directly cause, pipe sticking and twist-offs. This is especially true when drilling a deviated well since a bed of cuttings is almost always formed on the lower side of the drill pipe. By measuring the cuttings discharge at the surface, the buildup of cuttings in the well can be detected early and remedial action taken to prevent a catastrophic failure.

The cuttings from the well are discharged over a shale shaker screen to separate them from the drilling mud. Some of the mud adheres to the cuttings and is carried over with the cuttings discharged from the shale shaker. This portion of mud is lost to the mud system, which has been reported to be as high as two barrels of mud for every barrel of cuttings.

This invention provides a continuous, quantitative method of determining the hole-cleaning ability of the mud under specific drilling conditions by measuring the volume of cuttings being discharged from the shale shaker and also measuring the mud loss due to carryover. The quantitative measurement of these parameters makes possible the determination of the optimum annular mud velocity and the rheology of the mud to obtain the maximum removal of cuttings from the well. These continuous, quantitative measurements are not now being made during drilling operations by any system in use today.

SUMMARY OF THE INVENTION

In accordance with the present invention, a method and system is provided for continuously measuring the total volume of solid cuttings in a drilling mud being discharged from a well during a rotary drilling operation and the volume of mud carried over with the cuttings during separation by a shale shaker. The method comprises:

(a) measuring the density of the solid cuttings in said drilling mud;

(b) measuring the density of said drilling mud;

(c) passing the drilling mud discharged from the well through a shale shaker to remove the solid cuttings and mud carried over with the cuttings from the drilling mud;

(d) returning the drilling mud devoid of cuttings to the well drilling operation;

(e) withdrawing said solid cuttings and carryover mud from the shale shaker and constantly measuring the weight and volume of said cuttings and carryover mud;

(f) constantly determining the volume fraction of said cuttings $\phi_c$ in accordance with the following equation:

$$\phi_c = \frac{W_t/V_t - P_m}{P_c - P_m} \quad (1)$$

where:

$W_t$ is the total weight of a fixed volume of solid cuttings and carryover mud, $V_t$ is the total volume of solid cuttings and carryover mud, $p_m$ is the density of drilling mud, and $p_c$ is the density of cuttings; and (g) constantly determining the volume fracton of said carryover mud $\phi_m$ in accordance with the following equation:

$$\phi_m = 1 - \phi_c \quad (2)$$

where: $\phi_c$ is the volume fraction of solid cuttings determined in step (f).

The cuttings and carryover mud are discharged from the shale shaker onto an inclined diverting slide and then delivered into one of two weighing tanks partially filled with water. The water in the tanks eliminates any air that may be trapped by the cuttings and is essential in the measurement of the true volume of cuttings and carryover mud. The weight of each tank partially filled with water is measured and constitutes the tare weight of the tank before receiving the discharged cuttings and carryover mud from the shale shaker. As the cuttings and carryover mud are being discharged into one of the tanks, the weight and added volume in the tank is measured continuously. The weight is measured by load calls mounted on the legs of the tank in a way that eliminates errors due to an uneven distribution of cuttings. The volume in the tank is measured by a non-contacting measure of the height of the liquid in the tank, such as an ultrasonic measuring system which uses the travel time of an ultrasonic pulse from a transmitter near the top of the tank to the top of the liquid and back as a measure of the volume in the tank.

By continuously measuring the added weight and volume entering a tank the unknown total density of the effluent, $p_t = W_t/V_t$ can be determined at any instant. From this information, the volume fraction of the cuttings $\phi_c$ can be determined by equation (1) and the volume fraction of mud carryover $\phi_m$ can be determined by equation (2).

After the first weighing tank is filled, a diverting gate on the slide is automatically switched so that the second tank begins to fill with cuttings and carryover mud from the shale shaker. The full tank is then dumped and the contents fall into a cuttings pit. A spray of water, preferably from a circular ring sprayer located at the top of the tank, washes the tank to sweep away any remaining particles of mud and cuttings. A dumping gate on the tank is then closed, and the water spray continues until the water level reaches a pre-selected low-level setpoint at which time the water is shut off and the tank is again ready to receive another discharge of cuttings and carryover mud. After the second tank is filled, the cuttings and mud carryover discharged from the shale shaker are diverted into the first tank. The second tank is then emptied, washed, and partially filled with water which completes the automatic control cycle.

BRIEF DESCRIPTION OF THE DRAWINGS

In the drawings, where like numerals indicate like parts, illustrative embodiments of this invention are shown. A listing and brief description of each drawing is given below.

DESCRIPTION OF THE PREFERRED EMBODIMENTS

This invention relates to a method for measuring the volume of solid cuttings in a drilling mud discharged during a wellbore drilling operation as well as the volume of any mud carryover with the cuttings during their separation using a shale shaker. This invention provides a method of obtaining a continuous measurement of the hole-cleaning ability of the drilling mud under specific drilling conditions and the mud lost to the system during separation of the cuttings and the drilling mud.

Figure 1:
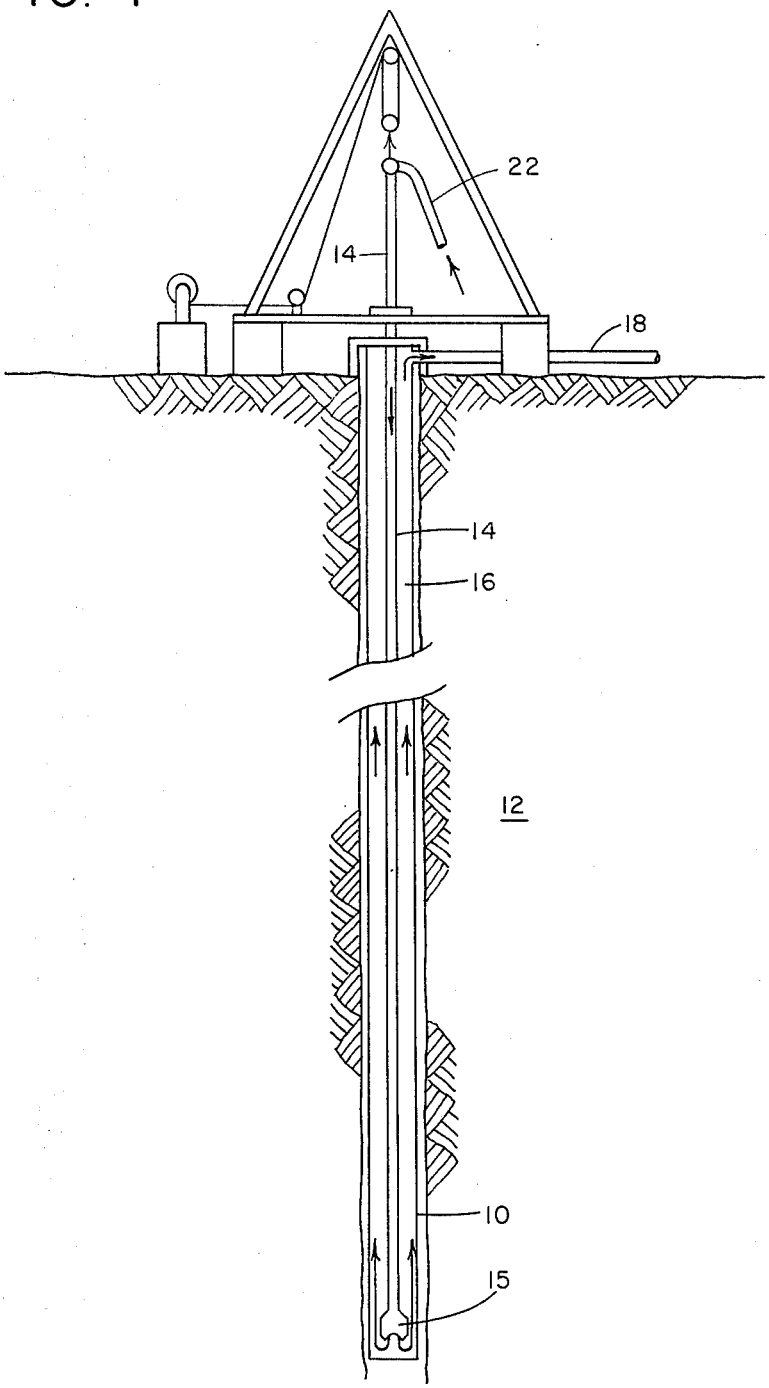
FIG. 1 is a diagrammatic vertical cross-section of a drilling well and the mud flow system components.

Referring now to FIG. 1, a vertical cross-section of a rotary drilling rig is illustrated. A well 10 is being drilled into a subterranean formation 12 while a drilling mud is being circulated down a drill string 14. The mud then passes through openings or jets in the drill bit 15 and back through the annular space 16 between the drill string 14 and the borehole well. The drilling mud picks up the cuttings produced by the drill bit 15 and transports these cuttings discharged from well 10 is delivered via line 18 to a shale shaker 20 shown in FIG. 2. Shale shaker 20 is of conventional construction with sloping vibrating screens onto which the drilling mud with cuttings via line 18 is discharged. The drilling mud passes through the shale shaker screens into a mud pit 21 located below the shale shaker 20, see FIG. 3. The drilling mud void of cuttings is pumped from mud tank 21 via a mud line (not shown) and recirculated down the drill string 14 via flexible mud hose 22 for reuse in the drilling operation. The solid cuttings and drilling mud adhering to the cuttings or carryover mud are retained on the shale shaker screens and discharged from the shale shaker 20, by gravity flow, onto an inclined diverting slide 24 and then delivered into one of two weighing tanks 26 and 28 supported by a skid-mounted platform 29.

The shale shaker slide 24 is provided with partitions 30, 32, and 34 that direct the solid cuttings and carryover mud into one of the two weighing tanks 26 and 28 depending upon the position of diverting gate 36. Partitions 32 provide a slide passage 38 in fluid communication with tank 26 and partitions 34 provide a slide passage 40 in fluid communication with tank 28. The active surfaces of slide 24 including passages 38 and 40 are covered with a low-friction material to prevent the solid cuttings and carryover mud from sticking to these surfaces. A vibrator may be used under the slide 24 to enhance the rapid removal of cuttings and carryover mud from the slide. The slide should be placed at a high angle of about 60° with respect to the ground level and the partitions 30, 32, and 34 should be high enough to prevent spill-over under the highest flow condition. The diverting gate 36 can be actuated hydraulically, electrically, pneumatically to shift the output of the slide from one weighing tank to the other. This gate is designed to prevent the wedging of cuttings in the passageway during closure.

Figure 3:
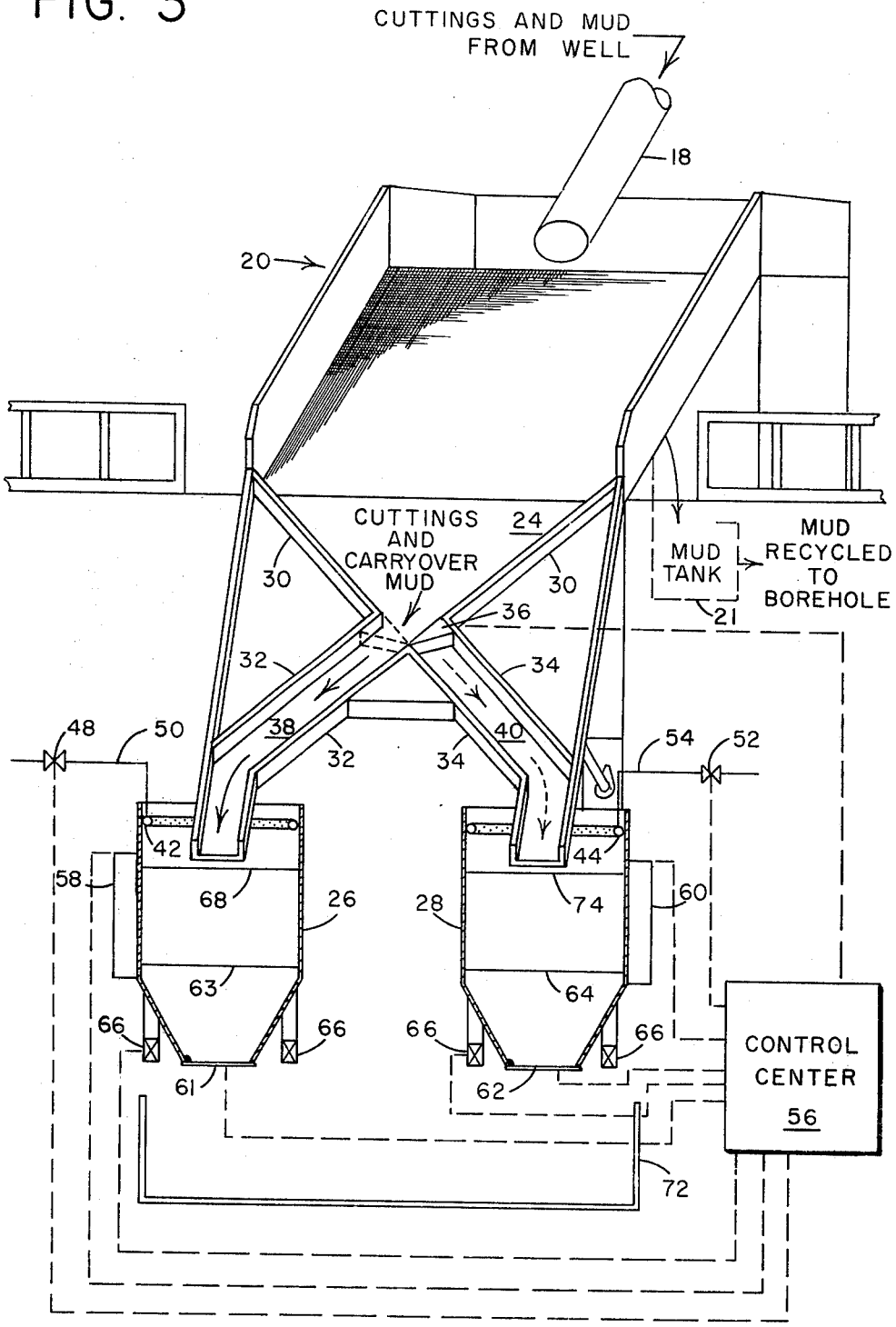
FIG. 3 is a schematic drawing of the cuttings slide and weighing tanks used to carry out the method of this invention.

Before the cuttings and carryover mud are discharged from shale shaker 20, tanks 26 and 28 are partially filled with water by means of circular perforated spray rings 42 and 44 located near the top of each tank, see FIG. 3, and provided with a plurality of spray nozzles (now shown). Water is delivered to spray ring 42 through valve 48 and line 50. Water is delivered to spray ring 44 through valve 52 and line 54. Control center 56 continuously monitors the volume of liquid in tanks 26 and 28 and when the volume of water reaches the level of meniscus 63 in tank 26 and meniscus 64 in tank 28, the flow of water into each tank is terminated by closing valves 48 and 52. The volume in each tank is determined by measuring the height of liquid in each tank by means of gauges 58 and 60 comprising stilling chambers in fluid communication with each tank through perforations (not shown) formed from inside the tank over the length of each stilling chamber. Gauges 58 and 60 as shown are mounted on the outside of the tank, however, they may also be mounted on the inside of the tank. Each stilling chamber is designed so as to eliminate the rolling action of the surface caused by cuttings falling into the tank. The upper portion of weighing tanks 26 and 28 have straight circular sides so that the measured height of the liquid in each tank 26 and 28 is directly proportional to the volume of the liquid in each tank. A transmitter (not shown) located near the top of gauges 58 and 60 emits an ultrasonic pulse and the round trip elapsed time of the pulse from the transmitter to the surface of liquid yields an accurate measure of the height of the liquid in the tank from which the volume can be determined. Signals from the ultrasonic pulse system are transmitted to control center 56. The liquid level measurement system may comprise an ultrasonic pulse system similar to the one available through Inventron Industries of Klamath Falls, Oregon.

The bottom portion of tanks 26 and 28 is a truncated right circular cone provided with hydraulically or pneumatically operated door valves 61 and 62 that permit the contents of each tank to be emptied.

The weight of tanks 26 and 28 partially filled with water to meniscus levels 63 and 64 is measured and this weight constitutes the tare weight of each tank before receiving solid cuttings and carryover mud discharged from shale shaker 20. The weight of tanks 26 and 28 is measured by load cells 66 mounted on at least three legs of each tank that eliminates errors due to an uneven distribution of cuttings.

Figure 2:
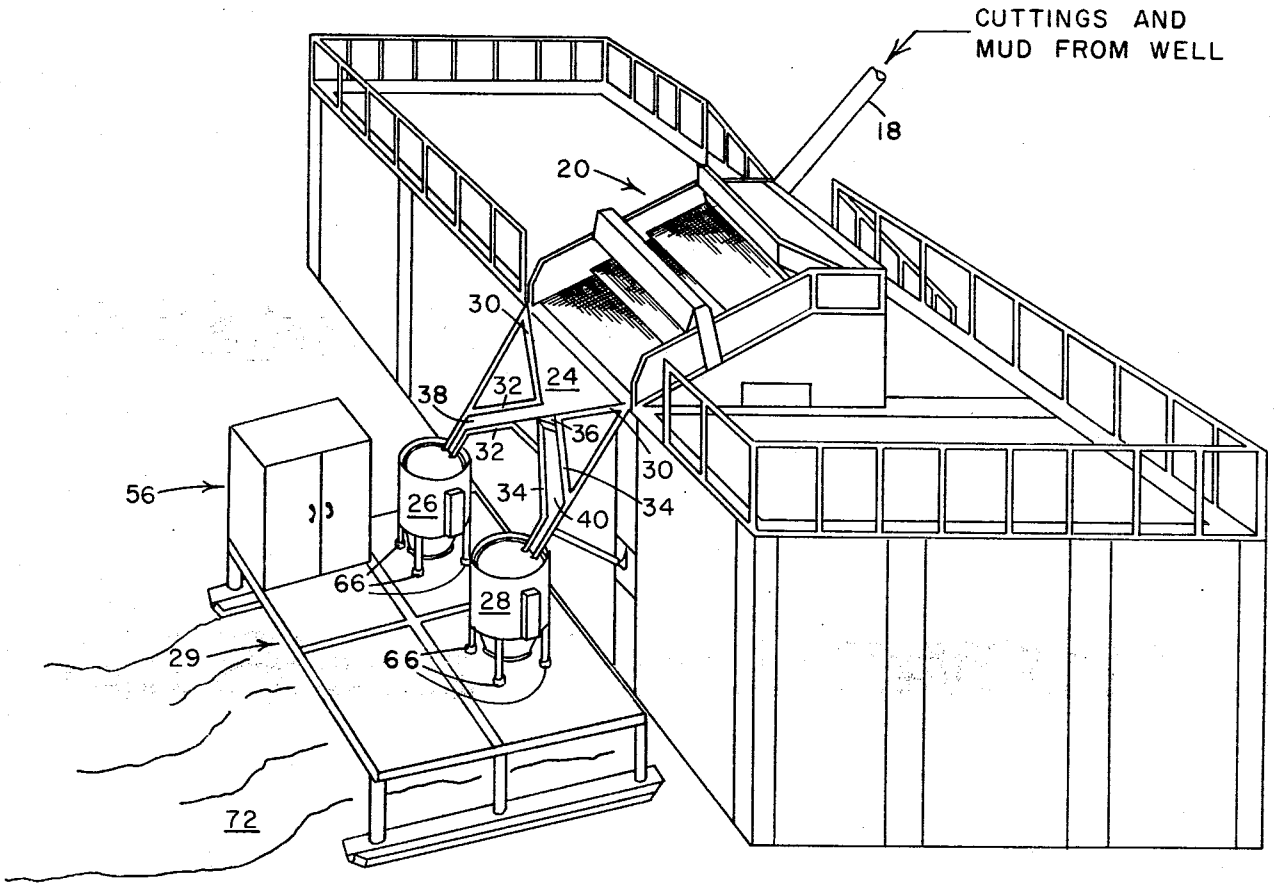
FIG. 2 illustrates the mud handling apparatus consisting of the shale shaker and mud pit in conjunction with the cuttings measuring system consisting of a diverting cuttings slide and two weighing tanks.

As shown in FIGS. 2 and 3, the position of gate diverter 36 is such that the solid cuttings and carryover mud are discharged from shale shaker 20 into tank 26 via passage 38. As the cuttings and carryover mud are discharged into tank 26, the weight and added volume in the tank is measured continuously by means of signals generated by load cells 66 and surface level gauge 58 transmitted to control center 56.

The densities of the mud and of the solid cuttings must be known to obtain a measurement of the cuttings and mud volumes. The density of the mud being used is measured by sampling the mud being pumped into the well. This measurement is generally determined in pounds-per-gallon. The density of the cuttings can be determined by accurately weighing a known volume of cleaned samples collected at the shale shaker discharge. The density of the cuttings can also be determined by knowing the type of formation being drilled and by referring to published tables to determine the value. This density is also expressed in the units of pounds-per-gallon. The variation in the density of cuttings from sedimentary rock covers a relatively narrow range from about 17 to 23 pounds-per-gallon and can be assumed to be a value within this range in most cases.

The stream of cuttings discharged from the shale shaker consists of solid cuttings and carryover mud. The total weight of a fixed volume of a discharge stream, with these two components, can be expressed by the equation:

$$W_t = W_m(1-\phi_c) + W_c\phi_c \tag{3}$$

where (in consistent units):

$W_t$ is the total weight of a fixed volume of cuttings and carryover mud, $W_m$ is the weight of the same fixed volume of carryover mud, $W_c$ is the weight of the same fixed volume of cuttings, $\phi_c$ is the fractional percentage of cuttings in the sample volume.

Solving for $\phi_c$, we obtain:

$$\phi_c = \frac{W_t - W_m}{W_c - W_m} \tag{4}$$

If we define the density, p, of each component as W/V, where the volume, V, is held constant, then, $$\phi_c = \frac{P_t - P_m}{P_c - P_m} \tag{5}$$

where:

$p_t$ is the density of the total stream, $p_m$ is the density of the mud, and $p_c$ is the density of the cuttings.

Since the density of the mud and cuttings are known, the total density can be expressed as $W_t/V_t$ and results in the equation:

$$\phi_c = \frac{W_t/V_t - P_m}{P_c - P_m} \tag{6}$$

The volume fraction of carryover mud $\phi_m$ is determined by the following equation:

$$\phi_m = 1 - c \tag{7}$$

By continuously measuring the added weight and volume entering tank 26 the unknown total density of the effluent, $p_t = W_t/V_t$ can be determined at any instant. From this information and the known densities of the mud and cuttings, the volume percent of the cuttings $\phi_c$ can be determined by equation (6) and the volume percent of the carryover mud $\phi_m$ can be determined by equation (7).

The volume percent of the cuttings and carryover mud is continuously monitored by control center 56 as determined by equations (6) and (7) until tank 26 is filled to a predetermined level indicated by meniscus 68. When tank 26 is filled to this volume, diverting gate 36 on slide 24 is automatically switched by a signal from control center 56 so that cuttings and carryover mud from shale shaker 20 are discharged into tank 28 via slide passage 40. The weight and volume of cuttings and carryover mud discharged into tank 28 are continuously measured by means of signals from load cells 66 and surface level gauge 60 transmitted to control center 56. Based on these measurements and the known densities mud and cuttings, the volume percent of the cuttings, the volume percent of the cuttings $\phi_c$ and mud $\phi_m$ are continuously determined by equations (6) and (7).

During the time tank 28 is being filled with cuttings and carryover mud, full tank 26 is emptied by a signal from control center 56 that opens bottom door valve 61 to permit the contents thereof to fall into cuttings pit 72. Thereafter, a signal from control center 56 opens valve 48 and water is injected into tank 26 via line 50 and spray ring 42 so as to wash the tank by sweeping away any remaining particles of cuttings and carryover mud. After tank 26 is thoroughly clean, door valve 61 is closed, and injection of water through spray ring 42 continues until the water level reaches the level of meniscus 63 at which time injection of water is terminated by closing valve 48 and the tank is again ready to receive cuttings and carryover mud from shale shaker 20. Tank 26 sits idle until companion tank completes its measuring cycle which occurs when the liquid level in tank 28 reaches meniscus 74, see FIG. 3.

After tank 28 is filled to meniscus level 74, diverter 36 is activated by control center 56 so that the cuttings and carryover mud are diverted into tank 26 via slide passage 38. During the time tank 26 is on stream, full tank 28 is emptied by a signal from control center 56 that opens bottom door valve 62 to permit the contents thereof to fall into cuttings pit 72. Thereafter, a signal from control center opens valve 52 and water is injected into tank 28 via line 54 and spray ring 44 so as to wash the tank. After tank 28 is thoroughly clean, door valve 62 is closed, and injection of water through spray ring 44 continued until the water level reaches the level of meniscus 64 at which time the injection of water is terminated by closing valve 54. Tank 28 is now ready to go back on stream as soon as tank 26 is filled.

This sequence of one tank continuously measuring the amount of cuttings and carryover mud from the shale shaker while the companion tank is being emptied, washed, and partially filled with water is repeated in cycles until the end of the test period.

The weighing tanks are the heart of the measuring system. The weight of the tank contents are made continuously along with the level of the contents to determine the volume. The tare weight includes the partial fill up of each tank with water to meniscus level 63 and 64 as shown in FIG. 3. The size of the tanks must be large enough to accommodate a volume of effluent large enough so that at least several minutes elapse at the highest expected flow rate before switching to the other tank. This time of fill up is dependent upon the wash-down time of the tank as well as the data sampling rate and accuracy required. To aid in the cleaning each tank by rinsing with water, the tanks may be lined with a low friction material.

Figure 4:
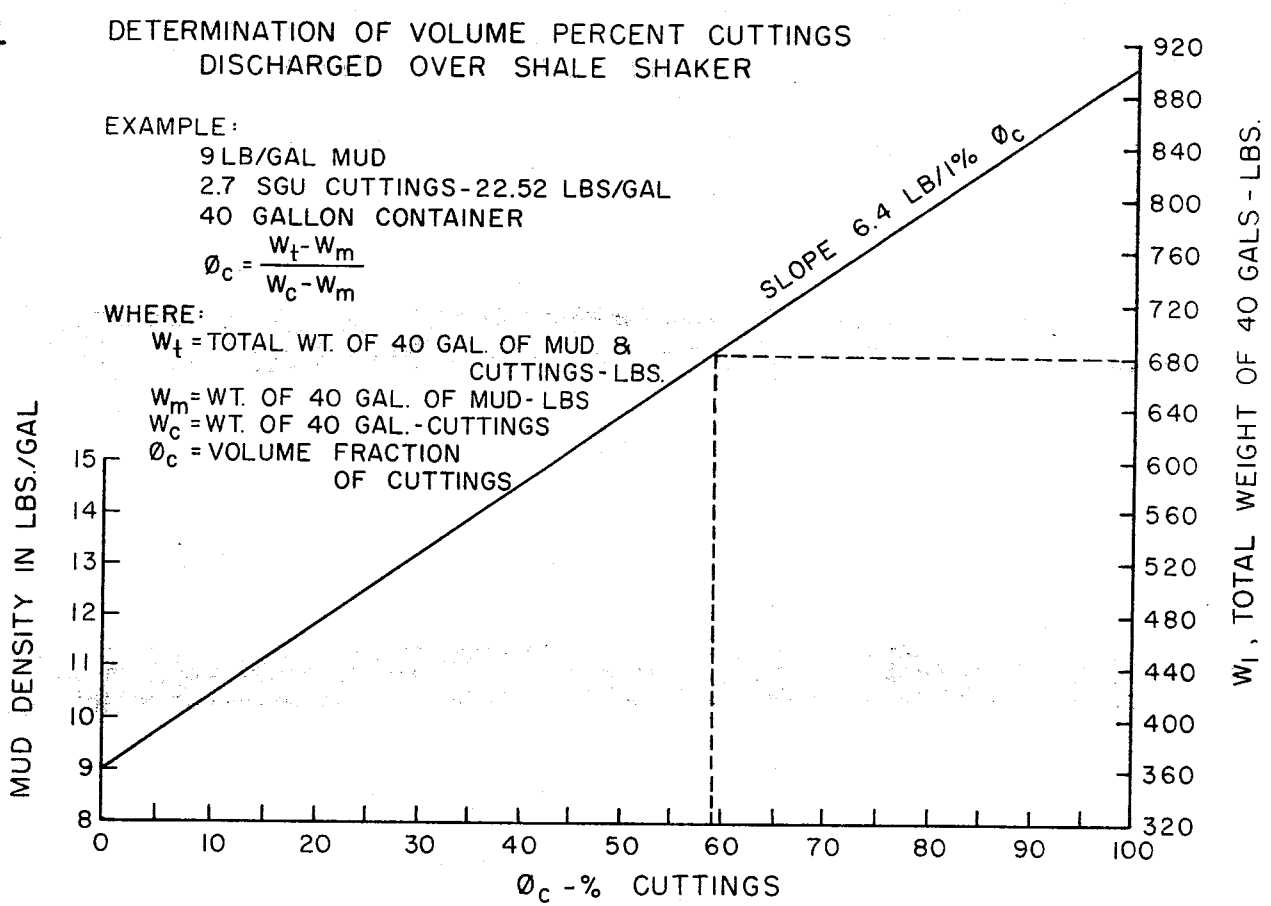
FIG. 4 is a graph showing the determination of the percent cuttings in a 40 gallon weighing tank using 9 pounds-per-gallon mud using the total weight of a full weighing tank as a parameter.

FIG. 4 is a plot that illustrates the relation between weight of the effluent stream received by a tank and the density of the mud used to drill the well when the volume of the added weight is known. This plot assumes that the tare weight of the tank and partial water fill-up has been subtracted so that the weight at the beginning of the measurement is zero. When the assumed 40 gallon tank is filled with 100% cuttings ($\phi_c$=100%) at a predetermined cuttings density of 22.52 lbs/gal, the total weight (Wt) is 901 pounds. This is the scale of the right-hand ordinate. The left-hand ordinate is basically to the same scale but is labeled in terms of mud density in lbs/gal. In other words, 40 gallons of 9 pounds-per-gallon mud weighs 360 pounds. The other mud densities are also exactly opposite the weight of 40 gallons of that density of mud. In this example, a circulated mud density of 9 pounds-per-gallon is chosen. The volume percent of the cuttings is determined by connecting the weight of 40 gallons of cuttings (901 lbs) with the mud density (9 lb/gal) and dividing the abscissa between the two points into 100 divisions to represent the volume percent of the cuttings, $\phi_c$. In this illustration, assuming the weight of the sample mixture measures 680 lbs, then by extending this weight to the calibration line, as shown by the dashed line, $\phi_c$ is determined to be about 59%. The remaining percentage, 41%, is the volume of the mud carried over the shale shaker. Therefore, 41% of the 40 gallons or 16.40 gallons of mud was lost from the mud circulating system along with 23.60 gallons of cuttings.

Figure 5:
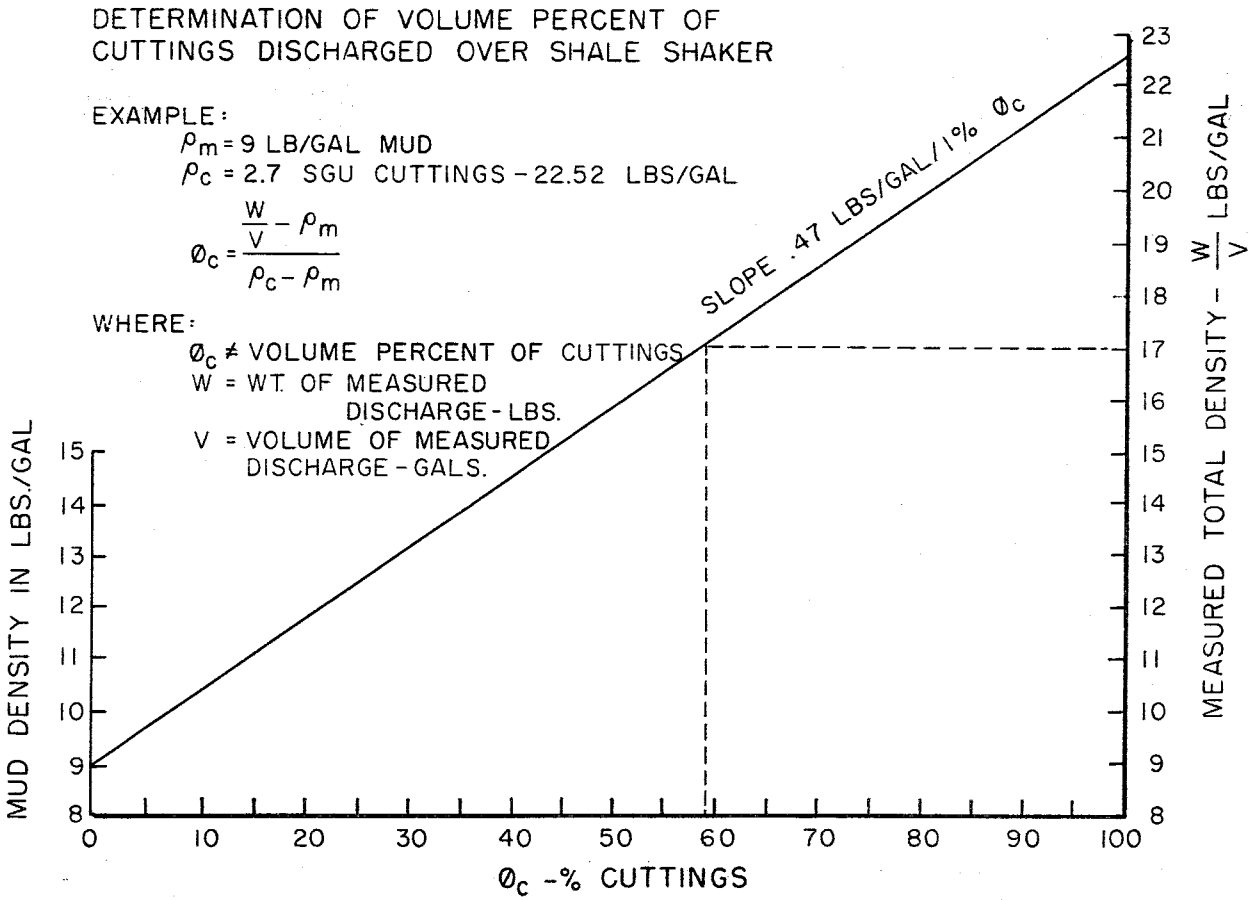
FIG. 5 is a graph showing the determination of the percent cuttings under the same conditions as in FIG. 4, but using the density of the cuttings and mud by measuring the instantaneous volume and weight in the tank.

This method of measurement has the shortcoming that it can be made only after the 40 gallon tank is completely filled. The utility of the system would be greatly enhanced if these measurements could be made any time during tank fill-up, so that small variations in cuttings return can be seen. FIG. 5 illustrates continuous measurements made by converting the weights to density on the right abscissa. On this illustration, assuming the density of the sample mixture is 17 lbs/gal and with a known mud density of 9 lbs/gal and a cuttings density of 22.52 lbs/gal, the volume percent of cuttings $\phi_c$ is determined to be about 59% as shown by the dashed line. The volume percent of carryover mud is 41%.

Figure 6:
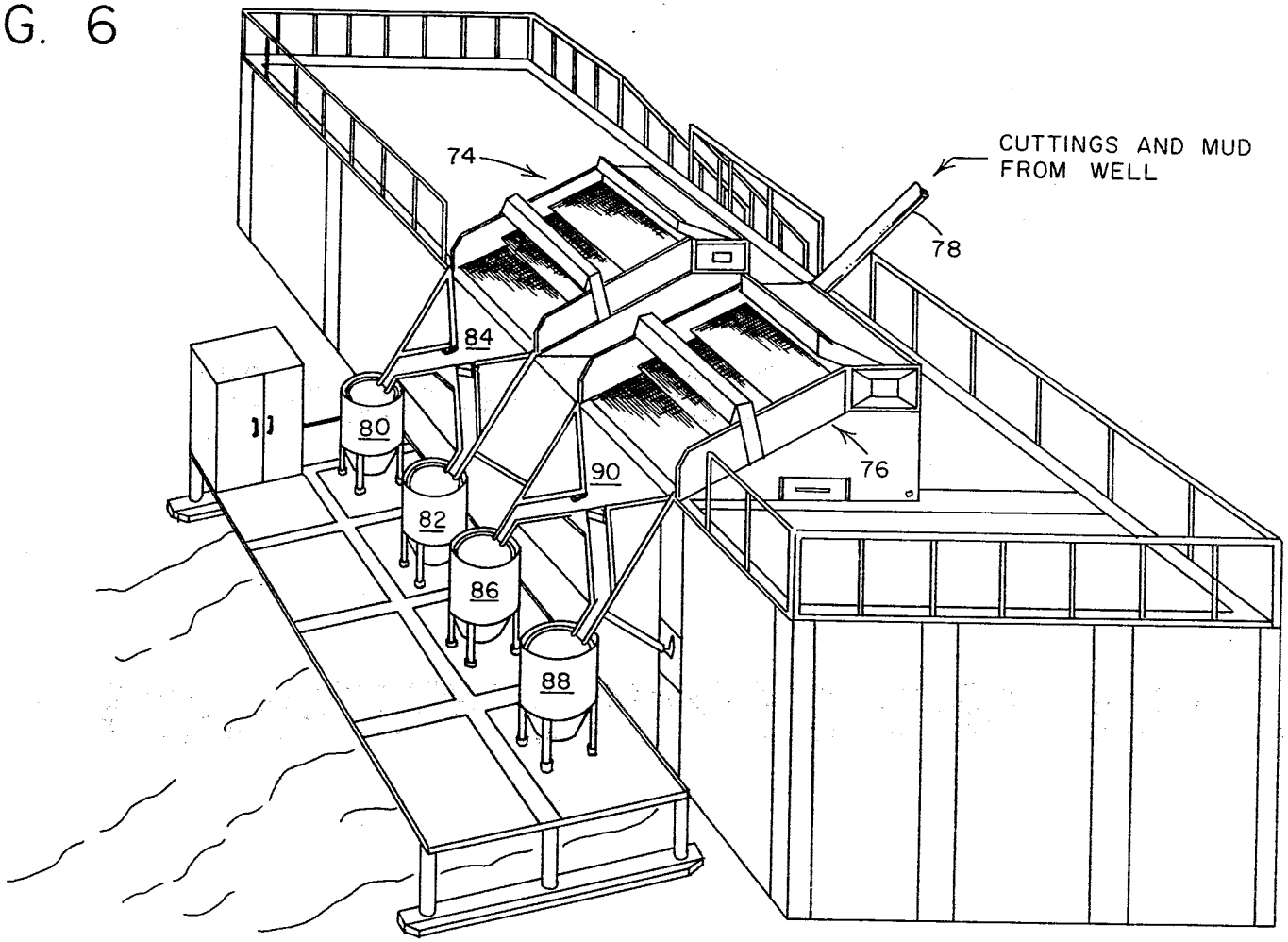
FIG. 6 is a pictorial view of a complete measurement system which uses two diverting slides and four weighing tanks.

While the invention has been described in terms of a single shale shaker, two or more shale shakers may be operated in parallel. This embodiment employing two shale shakers is illustrated in FIG. 6 wherein the drilling mud containing cuttings from the wellbore is delivered to shale shakers 74 and 76 via line 78. The cuttings and carryover mud from shale shaker 74 are discharged into one of two weighing tanks 80 and 82 located at the bottom of slide 84. The cuttings and carryover mud from shale shaker 76 are discharged into one of two weighing tanks 86 and 88 located at the bottom of slide 90. The drilling mud that passes through the screens of each shale shaker is recovered and recyled to the wellbore. The amount of cuttings and carryover mud discharged from each shale shaker 74 and 76 is continuously measured using the method as previously described for a single shaker as illustrated in FIGS. 2 and 3. This dual system will only require that the information acquired during the same time period from both systems would be summed to yield the total volume of cuttings measured from the well and the total volume of carryover mud.

Figure 7:
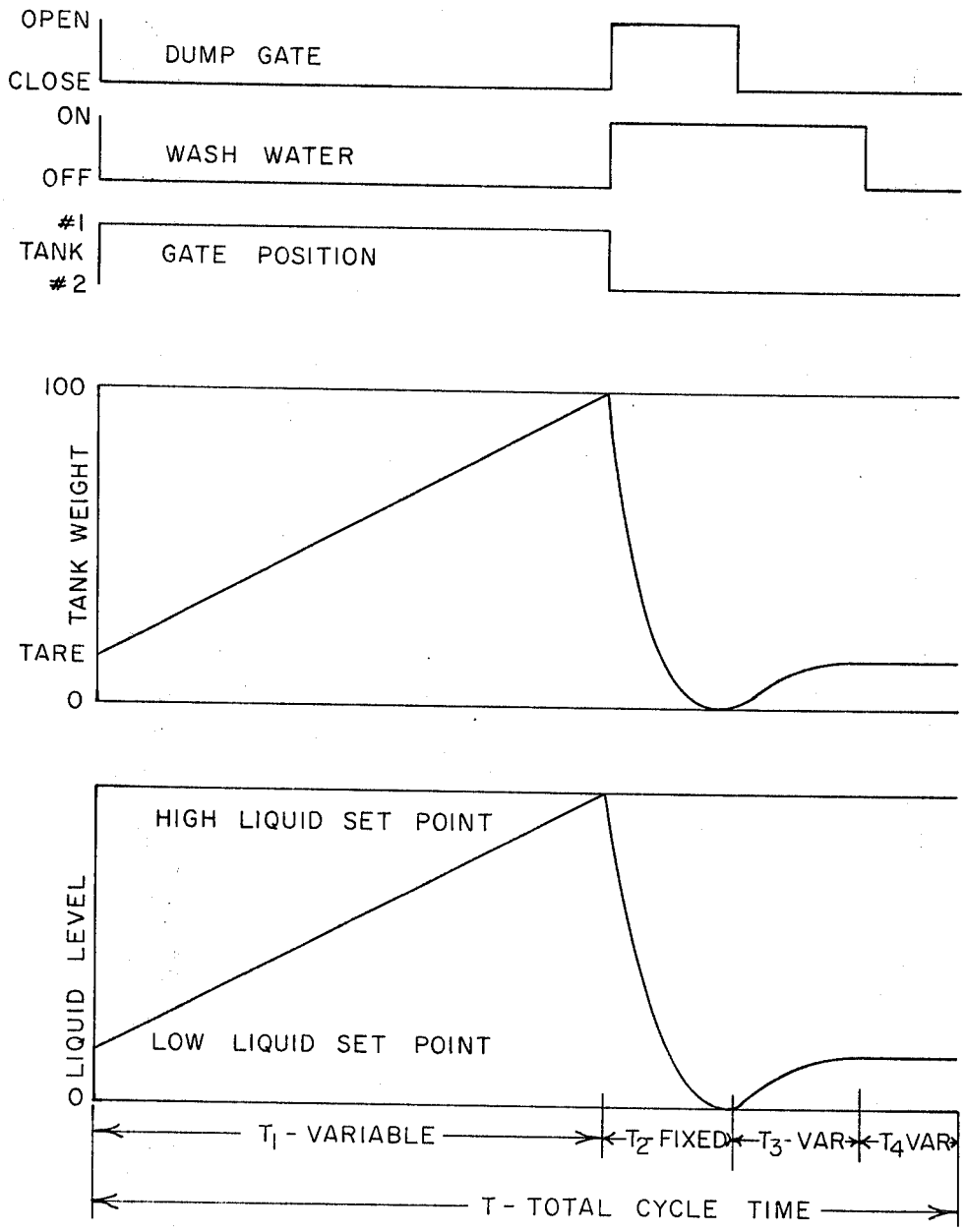
FIG. 7 depicts the timing cycle of the control system.

FIG. 7 illustrates the control sequence for a single weighing tank. The paired weighing tank cycle would begin at the end of time $T_1$ and would pass through the same sequence of operation. The tank fill-up time is variable, depending on the inflow rate. The period $T_2$ used to empty the tank would be fixed by a timer: $T_3$ is variable and is determined by the flow rate of the water and the volume required in any specific situation. Period $T_4$ is variable, depending solely upon the time it takes for tank #2 to fill up. This is a simple control system and could be operated electro-hydraulically or pneumatically.

The functions performed by the entire system must be coordinated by a central control system, which can be located on the platform near the weighing tanks as shown in FIGS. 2 and 6. A small microprocessor can be used to control the sequence, store the data, the perform the mathematical steps required to determine the amount of cuttings $\phi_c$ and carryover mud $\phi_m$. This method will produce data that is not now available and will not only permit the continuous determination of the hole cleaning ability of the mud but may be used to detect the invasion of gas or water into the borehole. When this information is used in conjunction with mud flow rate, rotary speed, rate of penetration and other drilling parameters, the lifting capabilities of the system can be optimized. Conversely, the effect of a change in the rheology of the mud can be evaluated under known drilling conditions. In addition, this method provides a measurement of mud loss due to carryover from the shale shaker which is an important parameter to be known in a mud drilling operation.

Having thus described the invention, it will be understood that such description has been given by way of illustration and example and not by way of limitation. The appended claims define the scope of the invention.

What is claimed is:

1. A method for continuously determining the amount of solid cuttings in a drilling mud discharged from a well drilling operation and the amount of mud carried over with the solid cuttings during separation of the cuttings from the drilling mud, comprising the steps of:

(a) measuring the density of the solid cuttings in said drilling mud;

(b) measuring the density of said drilling mud;

(c) passing the drilling mud discharged from the well through a shale shaker to remove the solid cuttings and mud carried over with the cuttings from the drilling mud;

(d) returning the drilling mud devoid of cuttings separated by the shale shaker to the well drilling operation;

(e) withdrawing said solid cuttings and carryover mud separated by the shale shaker and constantly measuring the weight and volume of said cuttings and carryover mud;

(f) constantly determining the volume fraction of said cuttings $\phi_c$ in accordance with the formula:

$$\phi_c = \frac{W_t/V_t - p_m}{p_c - p_m}$$

where:

$W_t$ is the total weight of a fixed volume of solid cuttings and carryover mud, $V_t$ is the total volume of solid cuttings and carryover mud, $p_m$ is the density of drilling mud, and $p_c$ is the density of cuttings; and (g) constantly determining the volume fraction of said carryover mud $\phi_m$ in accordance with the formula:

$$\phi_m = 1 - \phi_c$$

where: $\phi_c$ = volume fraction of solid cuttings determined in step (f).

2. A method for continuously determining the amount of solid cuttings in a drilling mud discharged from a well drilling operation and the amount of mud carried over with the solid cuttings during separation of the cuttings from the drilling mud, comprising the steps of:

(a) measuring the density of the solid cuttings in said drilling mud;

(b) measuring the density of said drilling mud;

(c) passing said drilling mud discharged from the well through a shale shaker to remove the solid cuttings and mud carried over with the cuttings from the drilling mud;

(d) returning the drilling mud devoid of cuttings separated by the shale shaker to the well drilling operation;

(e) withdrawing said solid cuttings and mud carryover separated by the shale shaker and introducing said mixture into a first weighing vessel containing a predetermined amount of water;

(f) constantly measuring the weight and volume of said solid cuttings and carryover mud introduced into said first weighing vessel;

(g) constantly calculating volume fraction of the cuttings $\phi_c$ in said first vessel in accordance with the formula:

$$\phi_c = \frac{W_t/V_t - p_m}{p_c - p_m}$$

where:

$W_t$ is the total weight of a fixed volume of solid cuttings and carryover mud, $V_t$ is the total volume of solid cuttings and carryover mud, $p_m$ is the density of drilling mud, and $p_c$ is the density of cuttings;

(h) constantly determining the volume fraction of said carryover mud $\phi_m$ in said first vessel in accordance with the formula:

$$\phi_m = 1 - \phi_c$$

where: $\phi_c$ = volume fraction of solid cuttings determined in step (g);

(i) diverting the flow of solid cuttings and mud from said first weighing vessel into a second weighing vessel containing a predetermined amount of water when the volume of said mixture in said first weighing vessel reaches a predetermined value;

(j) constantly measuring the weight and volume of said mixture of solid cuttings and carryover mud introduced in said second weighing vessel;

(k) constantly calculating the volume fraction of the cuttings in said second vessel in accordance with the formula:

$$\phi_c = \frac{W_t/V_t - p_m}{p_c - p_m}$$

where:

$W_t$ is the total weight of a fixed volume of solid cuttings and carryover mud, $V_t$ is the total volume of solid cuttings and carryover mud, $p_m$ is the density of drilling mud, and $p_c$ is the density of cuttings;

(l) constantly determining the volume fraction of said carryover mud in said second vessel in accordance with the formula:

$$\phi_m = 1 - \phi_c$$

where: $\phi_c$ = volume fraction of solid cuttings determined in step (k);

(m) discharging and washing the contents of said first weighing vessel when the volume of solid cuttings and carryover mud therein reaches the predetermined value of step; (i)

(n) injecting a predetermined volume of water into said first weighing vessel;

(o) diverting the flow of solid cuttings and carryover mud from said second weighing vessel into said first weighing vessel when the volume of said mixture reaches a predetermined value; and (p) repeating steps (f) thru (h);

(q) discharging and washing the contents of said second vessel when the volume of solid cuttings and carryover mud therein reaches the predetermined value of step (o); and (r) injecting a predetermined amount of water into said second weighing vessel.

3. The method of claim 2 wherein steps (e) through (r) are repeated for a plurality of cycles.

4. The method of claim 2 wherein the density of the cuttings is assumed to be within the range of 2.2 to 2.7 specific gravity depending upon the characteristics of the formation being drilled.

5. A drilling mud system including means for circulating a drilling mud through a well being drilled into a subterranean formation to remove solid cuttings therefrom comprising:

(a) means for measuring the density of the drilling mud being circulated through the well;

(b) means for measuring the density of the cuttings in the drilling mud discharged from the well;
(c) a shale shaker;
(d) means for delivering drilling mud containing solid cuttings discharged from the well onto the shale shaker;
(e) means for returning drilling mud passing through the shale shaker to the well;
(f) means for delivering solid cuttings and mud carried over with the said cuttings that are retained on the shale shaker to a reservoir means;
(g) means for constantly determining the weight and volume of the solid cuttings and carryover mud being delivered into said reservoir means;
(h) means for constantly determining the volume fraction of solid cuttings $\phi_c$ in said reservoir means in accordance with the formula:

$$\phi_c = \frac{W_t/V_t - p_m}{p_c - p_m}$$

where:
$W_t$ is the total weight of fixed volume of solid cuttings and carryover mud,
$V_t$ is the total volume of solid cuttings and carryover mud,
$p_m$ is the density of drilling mud, and
$p_c$ is the density of cuttings; and
(i) means for constantly determining the volume fraction of carryover mud $\phi_m$ in said reservoir means in accordance with the formula:

$$\phi_m = 1 - \phi_c$$

where: $\phi_c$ = volume fraction of solid cuttings determined in step (h).

6. A drilling mud system including means for circulating a drilling mud through a well being drilled into a subterranean formation to remove solid cuttings therefrom comprising:
(a) means for measuring the density of the drilling mud being circulated through the well;
(b) means for measuring the density of the cuttings in the drilling mud discharged from the well;
(c) a shale shaker;
(d) means for delivering drilling mud containing solid cuttings discharged from the well onto the shale shaker;
(e) means for returning drilling mud passing through the shale shaker to the well;
(f) means for delivering solid cuttings and mud carried over with said cuttings that are retained on the shale shaker into a first reservoir means;
(g) means for constantly determining the weight and volume of the solid cuttings and carryover mud delivered into said first reservoir means;
(h) means for constantly determining the volume fraction of solid cuttings $\phi_c$ in said first reservoir means in accordance with the formula:

$$\phi_c = \frac{W_t/V_t - p_m}{p_c - p_m}$$

where:
$W_t$ is the total weight of fixed volume of solid cuttings and carryover mud,
$V_t$ is the total volume of solid cuttings and carryover mud,
$p_m$ is the density of drilling mud, and
$p_c$ is the density of cuttings;
(i) means for constantly determining the volume fraction of carryover mud $\phi_c$ in said first reservoir in accordance with the formula:

$$\phi_m = 1 - \phi_c$$

where: $\phi_c$ = volume fraction of solid cuttings determined in step (h);
(j) means responsive to said first reservoir volume-measuring means for diverting the flow of solid cuttings and carryover mud from said first reservoir means to a second reservoir means when the volume of solid cuttings and carryover mud in said first reservoir means reaches a predetermined value;
(k) means for constantly determining the weight and volume of the solid cuttings and carryover mud delivered into said second reservoir means;
(l) means for constantly calculating the volume fraction of solid cuttings $\phi_c$ in said second reservoir means in accordance with the formula:

$$\phi_c = \frac{W_t/V_t - p_m}{p_c - p_m}$$

where:
$W_t$ is the total weight of fixed volume of solid cuttings and carryover mud,
$V_t$ is the total volume of solid cuttings and carryover mud,
$p_m$ is the density of drilling mud, and
$p_m$ is the density of cuttings;
(m) means for constantly calculating the volume fraction of carryover $\phi_m$ in said second reservoir means in accordance with the formula:

$$\phi_m = 1 - \phi_c$$

where: $\phi_c$ is the volume fraction of solid cuttings determined in step (1);
(n) means responsive to said first reservoir volume-measuring means for discharging and washing the contents of said first reservoir when the volume therein reaches the predetermined value of step (j);
(o) means for injecting a predetermined volume of water into said first reservoir means;
(p) means responsive to said second reservoir volume-measuring means for diverting the flow of solid cuttings and carryover mud from said second reservoir means to said first reservoir means when the volume therein reaches a predetermined value;
(q) repeating steps (g) thru (i);
(r) means responsive to said second reservoir volume measuring means for discharging and washing the contents of said second reservoir when the volume therein reaches the predetermined value of step (o); and
(s) means for injecting a predetermined volume of water into said second reservoir means.

7. The method of claim 6 wherein steps (f) thru (s) are repeated for a plurality of cycles.

8. A drilling mud system including means for circulating a drilling mud through a well being drilled into a subterranean formation to remove solid cuttings therefrom comprising:

(a) means for measuring the density of the drilling mud being circulated through the well;

(b) means for measuring the density of the cuttings in the drilling mud discharged from the well;

(c) a shale shaker;

(d) means for delivering drilling mud containing solid cuttings discharged from the well onto the shale shaker;

(e) means for returning drilling mud passing through the shale shaker to the well;

(f) an inclined slide;

(g) means for directing the solid cuttings and carryover mud retained on the shale shaker onto said slide;

(h) said slide comprising a main slide passage and first and second diverging branch slide passages;

(i) a movable blocking means mounted at the confluence of said branch slide passages and remotely operable actuator means for selectively positioning said blocking means to block passage of solid cuttings and mud into one of said slide passages with the normal position of said blocking means providing passage of solid cuttings and mud into the first diverging slide passage;

(j) a first vessel containing a predetermined volume of water in fluid communication with said first slide passage, said first vessel having a discharge means normally closed;

(k) means for passing the solid cuttings and carryover mud from said first slide passage into said first vessel;

(l) a second vessel containing a predetermined volume of water in fluid communication with said second slide passage, said second vessel having a discharge means normally closed;

(m) means for passing the solid cuttings and carryover mud from said second slide passage into said second vessel;

(n) means for constantly measuring the weight and volume of the solid cuttings and carryover mud introduced into said first vessel via said first slide passage;

(o) means responsive to the weight and volume of said solid cuttings and carryover mud introduced into said first vessel for constantly calculating the volume fraction of the cuttings $\phi_c$ therein in accordance with the formula:

$$\phi_c = \frac{W_t/V_t - p_m}{p_c - p_m}$$

wherein:

$W_t$ is the total weight of a fixed volume of solid cuttings and carryover mud, $V_t$ is the total volume of solid cuttings and carryover mud, $p_m$ is the density of drilling mud, and $p_c$ is the density of solid cuttings;

(p) means responsive to the weight and volume of said solid cuttings and carryover mud introduced into said first vessel for constantly determining the volume fraction of carryover mud $\phi_m$ therein in accordance with the formula:

$$\phi_m = 1 - \phi_c$$

where: $\phi_c$ = volume fraction of cuttings determined in step (o);

(q) means responsive to the volume of fluid in said first vessel being filled with solid cuttings and carryover mud discharged from the shale shaker for generating a control function when said volume of fluid therein reaches a predetermined high value;

(r) a first controller responsive to said control function of step (q) and operable to change the position of said movable blocking means so as to divert the flow of solid cuttings and carryover mud from the first vessel via the first slide passage to the second vessel via the second slide passage;

(s) a second controller simultaneously responsive to said control function of step and (q) and operable to open said discharge means in said first vessel to permit the contents thereof to be discharged from said first vessel;

(t) means responsive to the volume of fluid in said first vessel for generating a control function when said vessel is empty;

(u) a controller responsive to said control function of step (t) and operable to inject a predetermined amount of water into the upper portion of said first vessel for washing said vessel while maintaining the discharge means in said vessel open to allow the injected cleaning water to drain from the vessel;

(v) means responsive to the injection of the water into said first vessel during step (u) for generating a control function when a predetermined amount of water has been injected into said first vessel for cleaning;

(w) a controller responsive to said control function of step (v) and operable to close said discharge means in said first vessel and continue the injection of water into said first vessel;

(x) means responsive to the volume of water being injected into said first vessel for generating a control function when a predetermined amount of water has been injected to said first vessel;

(y) a controller responsive to said control function of step (x) and operable to terminate the injection of water into said first vessel when a predetermined amount of liquid has been injected;

(z) means for constantly measuring the weight and volume of the solid cuttings and carryover mud introduced into said second vessel during step (n);

(aa) means responsive to the weight and volume of said solid cuttings and carryover mud in said second vessel for constantly determining the volume fraction of the cuttings $\phi_c$ therein in accordance with the formula:

$$\phi_c = \frac{W_t/V_t - p_m}{p_c - p_m}$$

wherein:

$W_t$ is the total weight of a fixed volume of solid cuttings and carryover mud, $V_t$ is the total volume of solid cuttings and carryover mud, $p_m$ is the density of drilling mud, and $p_c$ is the density of solid cuttings;

(bb) means responsive to the weight and volume of said solid cuttings and carryover mud introduced into said second vessel for constantly determining the volume fraction of carryover mud $\phi_m$ therein in accordance with the formula:

$$\phi_m = 1 - \phi_c$$

wherein: $\phi_c$=volume fraction of cuttings determined in step (aa);

(cc) means responsive to the volume of fluid in said second vessel being filled with solid cuttings and carryover mud discharged from the shale shaker for generating a control function when said volume of fluid reaches a predetermined high value;

(dd) a first controller responsive to said control function of step (cc) operable to change the position of said movable blocking means so as to divert the flow of cuttings and mud from said second vessel via said second slide passage into said first vessel via said first slide passage;

(ee) a second controller simultaneously responsive to said control function of step (cc) and operable to open said discharge means in said second vessel to permit discharge of the solid cuttings and carryover mud from said second vessel;

(ff) means responsive to the volume of fluid in said second vessel for generating a control function when said second vessel is empty;

(gg) a controller responsive to said control function of step (ff) and operable to inject a predetermined amount of water into the upper portion of said second vessel for washing said vessel while maintaining the discharge means in said second vessel open to allow the injected cleaning water to drain from the vessel;

(hh) means responsive to the injection of the water into said second vessel during step (gg) for generating a control function when a predetermined amount of water has been injected into said second vessel for cleaning;

(ii) a controller responsive to said control function of step (hh) and operable to close said discharge means in said second vessel and continue the injection of water in said second vessel;

(jj) means responsive to the volume of liquid being injected into said second vessel for generating a control function when a predetermined amount of water has been injected;

(kk) a controller responsive to said control function of step (jj) and operable to terminate the injection of water into said second vessel when a predetermined amount has been injected.

* * * * *